US009381569B2

(12) United States Patent
Vogt et al.

(10) Patent No.: US 9,381,569 B2
(45) Date of Patent: Jul. 5, 2016

(54) VACUUM OR AIR CASTING USING INDUCTION HOT TOPPING

(71) Applicants: Russell G. Vogt, Yorktown, VA (US); Christopher R. Hanslits, Zuni, VA (US)

(72) Inventors: Russell G. Vogt, Yorktown, VA (US); Christopher R. Hanslits, Zuni, VA (US)

(73) Assignee: Howmet Corporation, Whitehall, MI (US)

( * ) Notice: Subject to any disclaimer, the term of this patent is extended or adjusted under 35 U.S.C. 154(b) by 88 days.

(21) Appl. No.: 13/815,503

(22) Filed: Mar. 7, 2013

(65) Prior Publication Data

US 2014/0251572 A1 Sep. 11, 2014

(51) Int. Cl.

| | |
|---|---|
| ***B22D 25/00*** | (2006.01) |
| ***B22D 27/15*** | (2006.01) |
| ***B22D 18/06*** | (2006.01) |
| ***B22D 21/02*** | (2006.01) |
| ***B22D 27/04*** | (2006.01) |
| *B22C 9/04* | (2006.01) |
| *B22C 9/08* | (2006.01) |

(52) U.S. Cl.

CPC ..... *B22D 25/00* (2013.01); *B22D 18/06* (2013.01); *B22D 21/025* (2013.01); *B22D 27/04* (2013.01); *B22D 27/15* (2013.01); *B22C 9/04* (2013.01); *B22C 9/086* (2013.01)

(58) Field of Classification Search

CPC ..... B22D 27/15; B22D 27/02; B22D 11/186; B22C 9/088

USPC ..... 164/492, 513, 5, 61, 63, 65, 160.1, 359, 164/360

See application file for complete search history.

(56) References Cited

U.S. PATENT DOCUMENTS

| | | | | | |
|---|---|---|---|---|---|
| 3,008,855 | A | * | 11/1961 | Swenson | 416/241 R |
| 3,310,850 | A | | 3/1967 | Armbruster | 22/73 |
| 3,420,291 | A | | 1/1969 | Chandley et al. | 164/66 |
| 3,788,382 | A | | 1/1974 | Daniel et al. | 164/150 |
| 3,841,384 | A | | 10/1974 | Tingquist et al. | 164/60 |
| 3,888,300 | A | | 6/1975 | Guichard et al. | 164/256 |
| 3,897,815 | A | * | 8/1975 | Smashey | 164/127 |
| 4,667,728 | A | * | 5/1987 | Graham | 164/129 |
| 4,733,714 | A | | 3/1988 | Smith | 164/130 |
| 4,738,713 | A | | 4/1988 | Stickle | 75/10.18 |
| 4,813,470 | A | | 3/1989 | Chiang | 164/122 |
| 4,832,112 | A | | 5/1989 | Brinegar et al. | 164/499 |
| 5,335,711 | A | | 8/1994 | Paine | 164/66.1 |
| 5,509,458 | A | | 4/1996 | Onuma et al. | 164/63 |
| 5,592,984 | A | | 1/1997 | Schmiedeknecht et al. | 164/62 |

(Continued)

FOREIGN PATENT DOCUMENTS

| | | |
|---|---|---|
| EP | 0944447 | 9/1999 |
| GB | 1 181 278 | 2/1970 |

(Continued)

*Primary Examiner* — Kevin P Kerns
*Assistant Examiner* — Steven Ha

(57) ABSTRACT

A method and apparatus for vacuum or air casting a molten superalloy, or other metal or alloy, containing an oxygen-reactive alloying element to form a cast part involves introducing the molten metallic material (melt) into a preheated mold having a melt reservoir, such as for example a mold pour cup, and gating for feeding the melt to one or more mold cavities. An induction coil disposed locally adjacent to the mold pour cup is energized in a manner to locally heat excess melt left in the melt reservoir to maintain it molten as the melt solidifies under vacuum or in air in the mold cavity to avoid shrinkage defects in the cast part.

19 Claims, 7 Drawing Sheets

(56) References Cited

U.S. PATENT DOCUMENTS

| | | | | |
|---|---|---|---|---|
| 5,860,468 | A | 1/1999 | Cook | 164/61 |
| 5,931,214 | A | 8/1999 | Spicer et al. | 164/258 |
| 6,019,158 | A | 2/2000 | Soderstrom | 164/133 |
| 6,070,564 | A | 6/2000 | Hiraoka et al. | 123/198 R |
| 6,253,828 | B1 | 7/2001 | Reiter | 164/61 |
| 6,446,698 | B1 | 9/2002 | Soderstrom et al. | 164/53 |
| 6,640,877 | B2 | 11/2003 | Soderstrom et al. | 164/122.1 |
| 7,779,890 | B2 | 8/2010 | Frasier et al. | 164/335 |
| 2007/0084581 | A1* | 4/2007 | Graham et al. | 164/122.1 |
| 2007/0227686 | A1* | 10/2007 | Ban et al. | 164/312 |
| 2013/0037232 | A1* | 2/2013 | Pham et al. | 164/61 |
| 2014/0037981 | A1* | 2/2014 | Cui et al. | 428/615 |

FOREIGN PATENT DOCUMENTS

| | | |
|---|---|---|
| JP | 61027166 | 2/1986 |
| JP | 10277702 | 10/1998 |

* cited by examiner

VACUUM OR AIR CASTING USING INDUCTION HOT TOPPING

FIELD OF THE INVENTION

The invention relates to a method for the vacuum or air casting of molten metallic material, such as for example, nickel or cobalt base superalloys, stainless steels, and the like in a preheated mold to make an improved cast part.

BACKGROUND OF THE INVENTION

Nickel base or cobalt base superalloys have been cast in investment molds in vacuum or air and then are moved to cool in air where exothermic material hot topping is applied to the mold pour cup to produce certain equiaxed grain cast gas turbine blades that are free of solidification shrinkage defects. For example, in casting such turbine blades, prior art workers have placed exothermic material, such as aluminum-containing powder material, on the molten superalloy reservoir remaining in the pour cup of the investment mold to keep molten after the mold is filled with molten superalloy and as soldification occurs in order to counter soldification shrinkage in the cast blade. This casting practice in air using such exothermic material is disadvantageous for several reasons that include, but are not limited to, occurrence of severe reactions (flash and burning) of the exothermic material upon contact with the molten superalloy in the mold pour cup as well as the need to safely remove the smoke and vapors from the containment area. Exposing a hot casting to air also promotes the formation of unwanted hafnium oxides as surface scale at last-to-solidify regions of the cast blade, such as the blade root when cast in the tip-down orientation. In addition, contamination of the superalloy material remaining in the pour cup from the reaction with the exothermic material occurs to such an extent that the contaminated pour cup material cannot be reused as revert (recycled) material in the casting of another part.

The use of exothermic material is described in U.S. Pat. No. 6,446,698 wherein a modified mold is used for casting molten metal or alloy. In particular, the mold is modified to have a destructible extension between the mold pour cup and a reservoir above the mold cavity and through which extension exothermic material is introduced and placed on the surface of the molten metal or alloy in the reservoir.

U.S. Pat. No. 3,841,384 describes a casting process sans exothermic material wherein an upper/lower split induction coil is used to heat a crucible placed on top of a mold to be cast. One of the coils is energized to first heat the crucible to melt a solid metal or alloy charge therein and then both coils are energized to impart superheat to the melt in the crucible and to preheat the mold for casting to receive molten metal or alloy from the crucible.

U.S. Pat. Nos. 5,592,984; 6,019,158; and 6,640,877 describe casting methods sans exothermic material for reducing shrinkage defects upon solidification of molten metal or alloy in a preheated mold by pressurizing the casting chamber or by placing a pressurizing cap on the mold after it is filled with molten metal. The entire mold is preheated prior to casting with no further mold heating.

U.S. Pat. No. 4,832,112 discloses the MX casting process sans exothermic material wherein a molten metal or alloy with controlled low superheat is cast into a mold and subjected to electromagnetic stirring to induce turbulence in the molten metal or alloy in the mold without substantial heating thereof.

SUMMARY OF THE INVENTION

The present invention provides a method and apparatus for casting a molten metallic material under vacuum or in ambient air sans exothermic material to form a cast part that is free of shrinkage defects.

In accordance with an illustrative embodiment, the method and apparatus involve introducing molten metallic material (melt) into a preheated mold wherein the mold has a melt reservoir, such as a pour cup, and gating that feeds the melt to one or more mold cavities. Excess melt is provided in the melt reservoir, such as the pour cup, and the gating for feeding to the one or more mold cavities during solidification there. An induction coil is disposed locally adjacent to the melt reservoir and is energized in a manner to locally heat the excess melt in the melt reservoir to maintain it molten as the molten metallic material solidifies in the one or more mold cavities of the preheated mold. The excess molten metallic material is fed as needed to eliminate shrinkage defects as solidification proceeds in the mold cavity.

In an illustrative embodiment of the invention, the preheated mold and the induction coil are relatively moved in a vacuum chamber or in air so that the induction coil resides locally around the melt reservoir prior to introduction of the molten metallic material into the preheated mold. The induction coil is energized to locally heat the excess molten metallic material in the melt reservoir to maintain it molten without substantially heating the region of the mold in which the one or more mold cavities reside.

A particular illustrative embodiment of the invention involves vacuum casting a molten superalloy containing an oxygen-reactive alloying element (alloyant) (e.g. hafnium, zirconium, titanium, aluminum, etc.) wherein molten superalloy is introduced into a mold pour cup (or other reservoir) and gating of a preheated ceramic investment mold residing in a vacuum chamber at less than 0.020 mm Hg so as to fill a mold cavity with the molten superalloy and wherein an induction coil disposed locally around the melt pour cup (or other reservoir) is energized to locally heat the excess molten superalloy remaining in the melt reservoir to maintain it molten as the superalloy solidifies under vacuum in the mold cavity of the preheated mold to produce an equiaxed grain, superalloy cast part without shrinkage defects and without the presence of a hafnium or other reactive element oxide scale. The mold cavity can have the shape of a gas turbine blade, vane, or other component in certain embodiments of the invention.

In still another embodiment, the present invention provides an apparatus for vacuum casting of a molten metallic material, wherein the apparatus includes a vacuum casting chamber that receives a preheated mold having a melt reservoir and gating communicated to a mold cavity to fill the mold cavity with the molten metallic material from the reservoir and further includes an induction coil disposed locally adjacent to the melt reservoir and energizable by a power source in a manner to locally heat the excess molten metallic material in the melt reservoir to maintain it molten as the molten metallic material solidifies under vacuum in the mold cavity of the preheated mold. The vacuum casting chamber is communicated to a mold preheating chamber when a valve therebetween is opened pursuant to a particular embodiment of the invention. The induction coil and the preheated mold are relatively movable to position the induction coil locally around the melt pour cup (or other reservoir). A molten metal or alloy filter may optionally be provided in the pour cup, reservoir, and/or gating.

In still a further illustrative embodiment useful, although not limited to, casting of stainless steel, the method and apparatus involve introducing molten metallic material (melt) into a preheated mold in ambient air (atmospheric air) wherein the mold has a melt reservoir, such as a pour cup, and gating that feeds the melt to one or more mold cavities. Excess melt is provided in the melt reservoir, such as the pour cup, and the gating for feeding to the one or more mold cavities during solidification there. An induction coil is disposed locally adjacent to the melt reservoir and is energized in a manner to locally heat the excess melt in the melt reservoir to maintain it molten as the molten metallic material solidifies in air in the one or more mold cavities of the preheated mold. The excess molten metallic material is fed as needed to eliminate shrinkage defects as solidification proceeds in air in the mold cavity.

Practice of the present invention is advantageous to avoid occurrence of severe reactions (flash and burning) associated with previously-used exothermic material placed on the melt in the mold pour cup, to avoid contamination of solidified metallic material remaining in the mold pour cup after soldification so that it can be reused, to avoid shrinkage defects in the cast part, and to avoid the formation of unwanted reactive element oxides as surface scale at last-to-solidify regions of the cast part when certain superalloys are cast.

These and other advantages of the invention will become more readily apparent to those skilled in the art from the following detailed description taken with the following drawings.

DETAILED DESCRIPTION OF THE INVENTION

Figure 1:
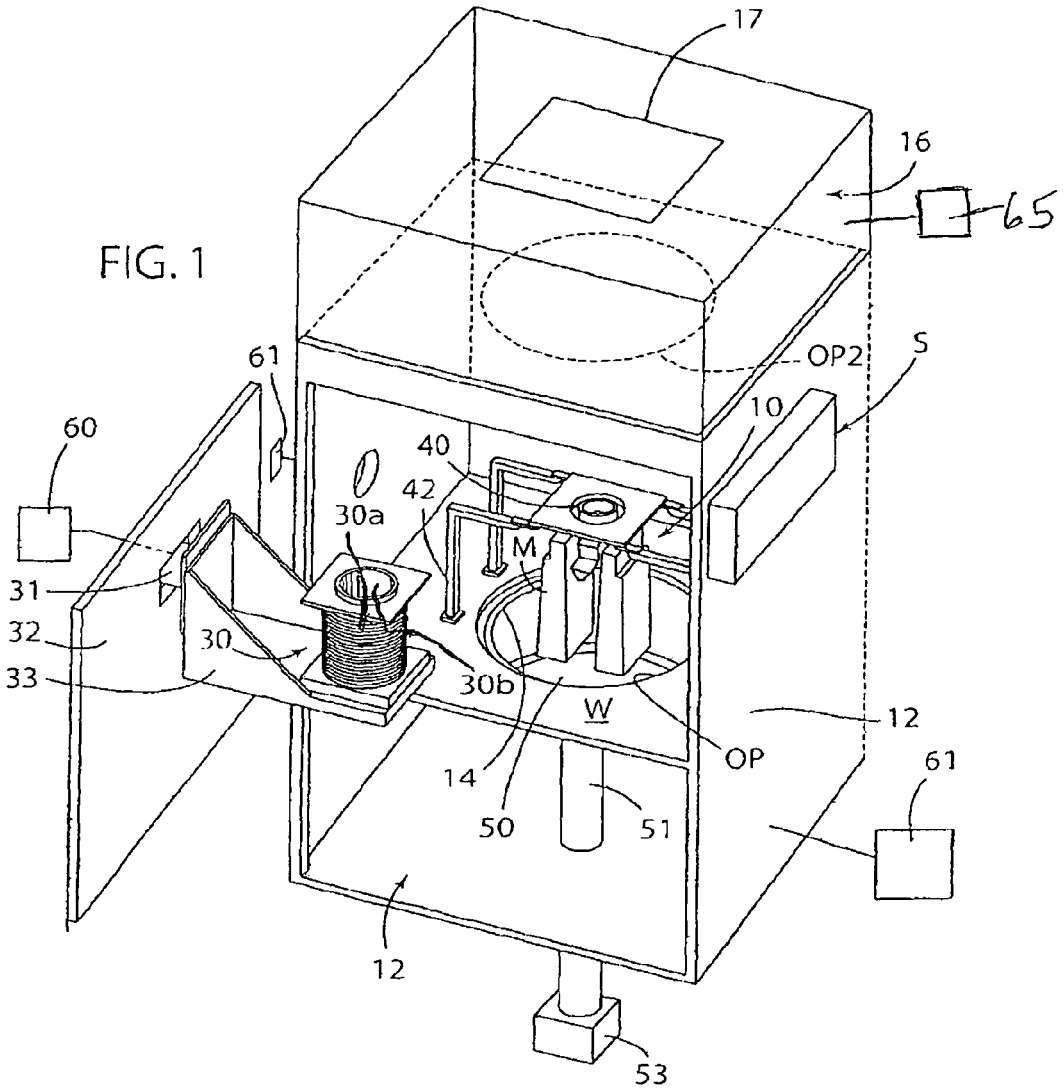
FIG. 1 is a schematic perspective view of vacuum casting apparatus pursuant to an illustrative embodiment of the invention.

One illustrative embodiment of the invention relates to the vacuum casting of molten metallic material in a preheated mold in a vacuum casting chamber under conditions that reduce or eliminate shrinkage defects in the cast part and unwanted oxide surface scale on the cast parts. Moreover, the vacuum casting method is conducted under conditions that avoid contamination of solidified metallic material remaining in the mold pour cup (or other reservoir) after soldification so that it can be reused as revert in the casting another cast part.

FIGS. 1-5 show apparatus pursuant to an illustrative embodiment of the invention for vacuum melting and casting a metallic material pursuant to illustrative embodiments of the invention. Metallic materials which can be vacuum melted and cast include, but are not limited to, metals, metal alloys, intermetallic compounds, and other metallic materials. For purposes of illustration and not limitation of the invention, the method and apparatus will be described in connection with the vacuum melting and vacuum casting of a nickel base superalloy (or cobalt base superalloy) of the types used in the manufacture of gas turbine components, such as turbine blades, turbine vanes, turbine buckets and other components. Such nickel base superalloys and cobalt base superalloys are well known and include, but are not limited to, Mar-M 247 and Rene 80. The invention is especially useful in the vacuum casting of nickel base or cobalt base superalloys that contain oxygen-reactive alloying elements, such as hafnium (Hf), zirconium (Zr), titanium (Ti) aluminum, etc. that, when cast in air, form unwanted oxide scales (e.g. hafnium oxide) on last-to-solidify or other regions of the cast part.

The illustrative apparatus comprises upper vacuum casting chamber 10 and a lower mold-receiving chamber 12 communicated to one another by a movable (e.g. slidable) valve 14 residing on intermediate chamber wall W for opening and closing the opening OP through which mold M moves between chambers 10, 12. When a preheated mold M is to be transferred from the mold-receiving chamber 12 to the vacuum casting chamber 10 for casting, the valve 14 is opened, and the preheated mold M is raised by elevator 50 upwardly into the vacuum casting chamber 10. The upper vacuum casting chamber 10 is maintained under a vacuum (subambient pressure), such as less than about 0.020 mm Hg and preferably less than 0.001 mm Hg when a nickel base or cobalt base superalloy is being melted and cast in the preheated mold in the chamber 10. The lower mold-receiving chamber 12 typically is maintained at the same vacuum level as chamber 10 once the preheated mold is received in the chamber 12.

Typically, the mold M is preheated in a separate external mold preheat furnace (not shown) that can be gas-fired, electrical or other type. The preheated mold M then is moved from the preheating furnace into the mold-receiving chamber 12. The mold M is manually or robotically moved into chamber 12 through a gas-tight sealable door 32 that opens to ambient air atmosphere. The preheated mold M can be positioned in chamber 12 onto a mold-locating fixture or stand 72 residing on a lift or elevator 50, FIG. 4. The elevator 50 is raised or lowered via a ram 51 and ram actuator 53, such as a hydraulic, electrical or other motor, located outside or inside chamber 12. After the door 32 is closed and gas-tight sealed, a relative vacuum typically is established in the chamber 12 by one or more suitable vacuum pump(s) 61.

The lower mold-receiving chamber 12 optionally may include conventional electrical resistance heating coil(s) or other heating device to preheat or supplement preheating the mold M to a suitable elevated temperature for casting in chamber 10.

The upper vacuum casting chamber 10 includes a melting crucible 30 that can be an induction melting crucible having one or more induction coils **30*a* around a ceramic melting crucible liner 30*b* as shown in FIG. 1, an electrical resistance melting crucible, or any other suitable melting crucible to melt a solid charge of nickel base or cobalt base superalloy and to discharge (pour) the melted charge from the crucible 30 into the pour cup PC of the mold M by rotation of the crucible via a crucible shaft 31 and a suitable rotary motor 60' connected to the shaft 31. The shaft 31 is connected to a crucible support shelf 33 on which the crucible 30** is fixedly mounted for rotation with the support shelf.

The crucible 30 optionally can include a bottom melt discharge opening (not shown) communicated to the pour cup PC of the mold M wherein the bottom melt discharge opening can be closed by a ceramic stopper rod or other suitable valve to control melt discharge to the pour cup PC (or other reservoir) of the preheated mold M below.

The solid charge to be melted can comprise a metal ingot, bar, or other solid stock or a prealloyed ingot, bar or other solid stock. Alternately, the solid charge can comprise appropriate proportions of respective elemental metallic constituents and/or non-metallic constituents of an alloy. The solid charge is introduced into a separate solid charge-receiving chamber 16 via a door 17. The chamber 16 is located above the chamber 10 and communicated thereto by a valved opening OP2 similar to opening OP between the chambers 10, 12 that is closed/opened by valve 14. After the solid charge to be melted is placed in the chamber 16 and the door 17 closed, the chamber 16 can be evacuated by one or more suitable vacuum pumps 65 so that the solid charge to be melted can be lowered from chamber 16 into the crucible 30 in evacuated chamber 10 by a hoist or other transfer device residing in chamber 16.

The crucible 30 is mounted on movable door 32 that opens to the ambient air atmosphere to permit a preheated mold M to be placed on the elevator 50 in the chamber 12. The door 32 is movable to a closed, gas-tight sealed position forming a wall or wall portion of the chambers 10, 12 so that the desired vacuum level can be established in the chambers 10, 12 by the vacuum pump(s) 61. For purposes of illustration and not limitation, in vacuum melting and casting of nickel base or cobalt superalloys, a vacuum level of less than 20 microns-Hg (μm-Hg) is typically established in the chamber 10 and chamber 12.

When the door 32 is closed and vacuum-tight sealed, the crucible 30 is positioned above a vacuum induction hot topping induction coil (VIHT coil) 40 mounted on one or more support plates 41 that, in turn, are supported on a first cross support frame 42. The cross frame 42, in turn, is adjustably mounted on the top rails of the second support frame 44, which includes adjustment holes 45 so that the position of the VIHT coil 40 can be initially adjusted relative to the position of the melt stream poured from the crucible 30 into the mold M. The second frame 44 is mounted on the intermediate wall W disposed between the mold preheating chamber 12 and the vacuum casting chamber 10.

The VIHT coil 40 comprises a water-cooled copper tubing coil faced on its inner surface with a ceramic grout material such as a zircon, alumina, silica, or a mixture thereof to protect the tubing coil from the heat of the melt stream discharged from the crucible 30. To this end, the coil 40 includes suitable fittings F to connect to cooling water conduits represented by arrows in FIG. 5.

Figure 2:
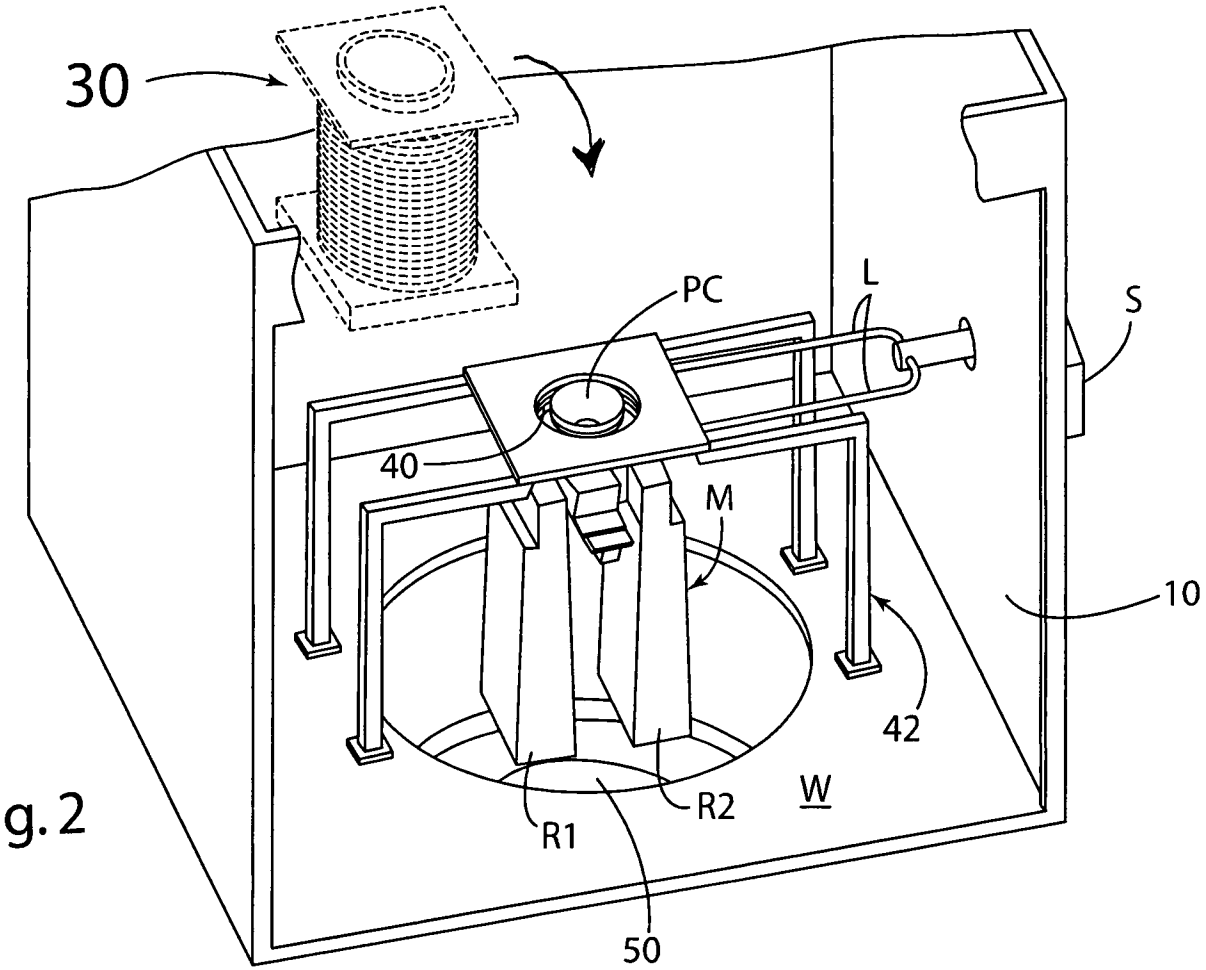
FIG. 2 is an enlarged schematic perspective view of the vacuum casting chamber having a vacuum induction hot topping induction coil (VIHT coil) for locally heating excess molten metallic material in the mold pour cup (melt reservoir).

Electrical power is supplied to the coil 40 by electrical power wires shown schematically as lines L, in FIG. 2, from an external power source S, such as an Inductotherm Vacuum Induction power source, mounted on the exterior of the adjacent wall of the vacuum casting chamber 10 or other suitable location.

In FIGS. 1-4, the mold M is illustrated as a ceramic investment shell mold having a pour cup PC (melt reservoir) communicated by gating G to dual mold cavities MC1, MC2 residing within respective mold cavity-forming mold regions R1, R2 of the mold. The mold cavities MC1, MC2 (shown schematically) can have the shape of a gas turbine engine blade to be cast, although the mold cavities can have any other shape corresponding to the cast part to be made. The ceramic investment shell mold is formed as one-piece by the well known lost wax investment molding process. The invention, however, envisions using other types of molds such as including, but not limited to, machined refractory metal or ceramic molds, or preformed ceramic molds.

Moreover, although the illustrative embodiments of FIGS. 1-4 show the mold M as having an integral upper pour cup PC to function as the melt reservoir, the invention envisions use of other types of molds having an internal melt reservoir or of molds having a melt reservoir separate from the mold yet communicated to the mold cavities to provide excess melt therein for feeding to the mold cavities during soldification to eliminate shrinkage defects in the cast part.

Figure 3:
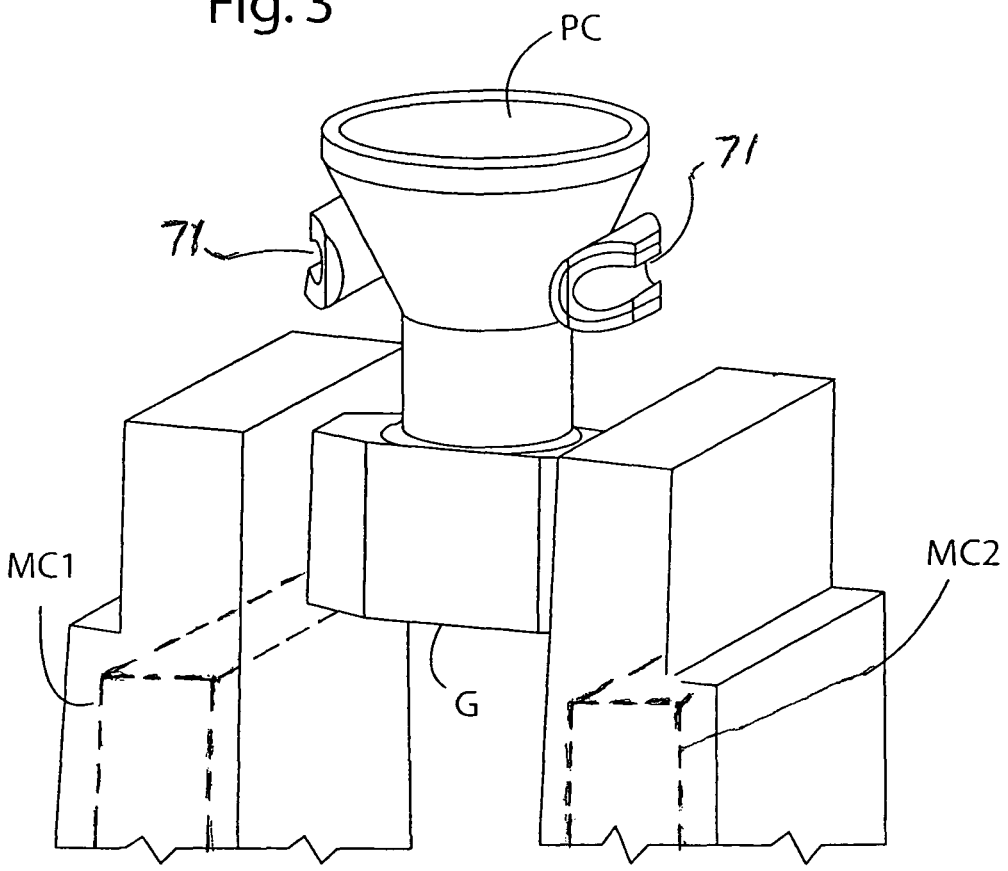
FIG. 3 is a schematic perspective view of the upper region of a ceramic investment shell mold having a pour cup and dual mold cavity regions connected by gating.
Figure 4:
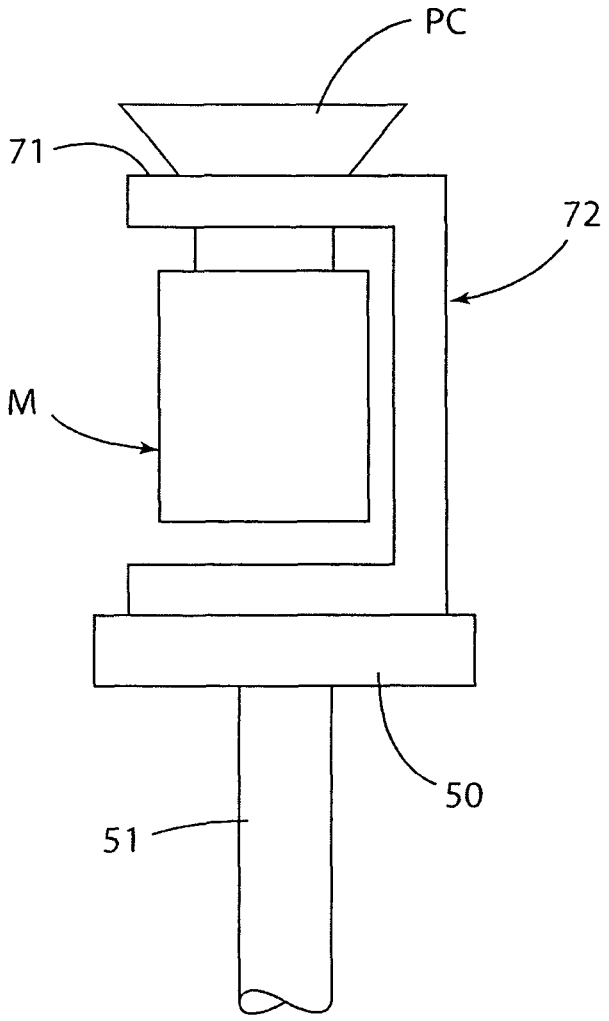
FIG. 4 is a schematic elevation of a preheated mold placed on a mold-locating fixture or stand that is carried on an elevator between a lower mold-receiving chamber and an upper vacuum casting chamber of FIG. 1.
Figure 5:
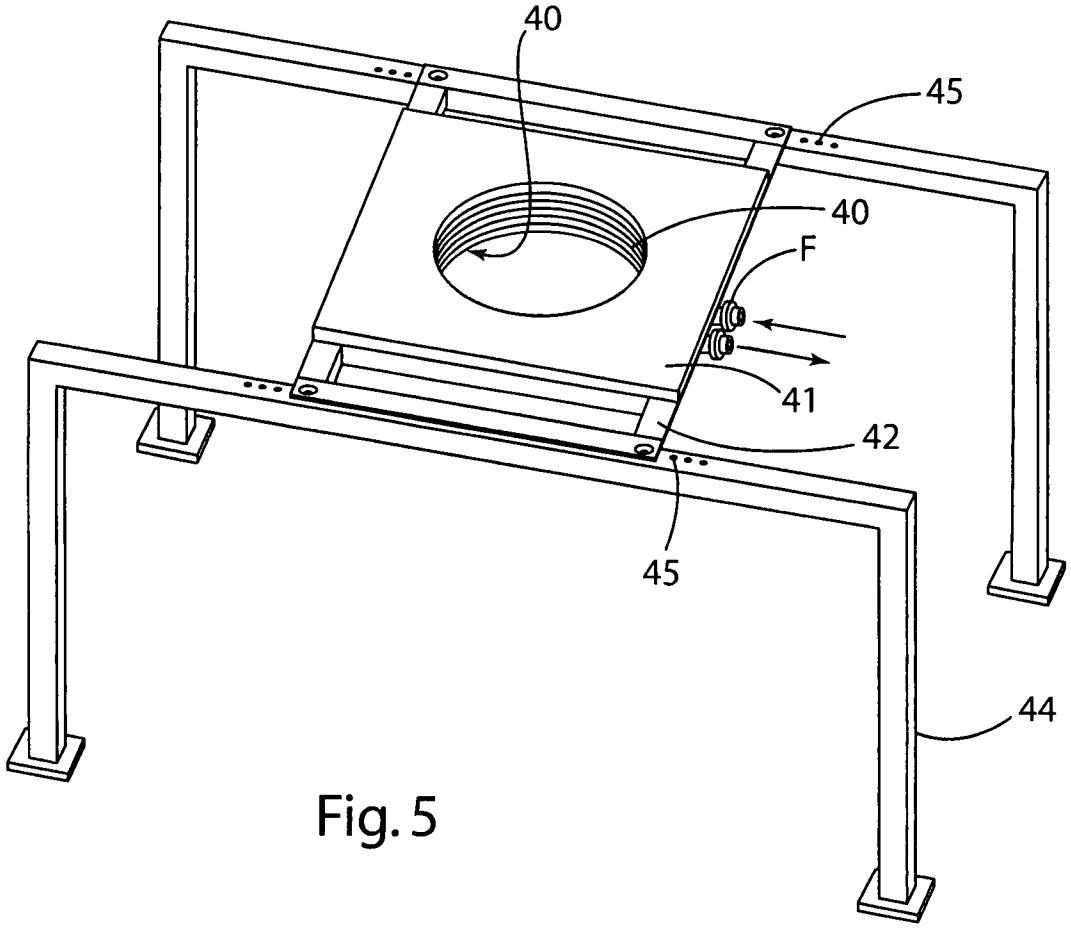
FIG. 5 is a schematic perspective view of the induction coil support frames and the VIHT coil mounted on the support frames.

In FIGS. 3-4, the mold pour cup PC of the preheated mold M is illustrated as being initially positioned on locating tubes 71 of the mold-locating fixture or stand 72 that is fixedly mounted on the elevator 50 in the chamber 12. The elevator 50 then is raised to position the preheated mold to the casting position shown in FIGS. 1 and 2 in vacuum chamber 10.

Figure 7:
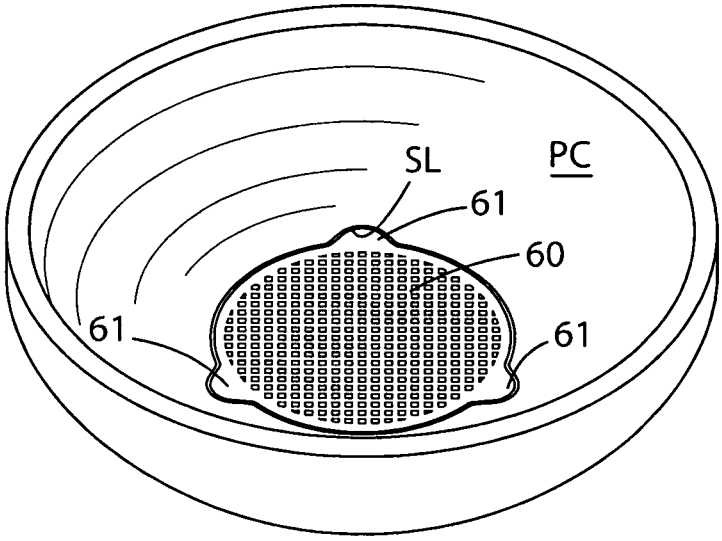
FIG. 7 is a perspective view of a molten metal filter residing in the mold pour cup.

A molten metal filter 60 may be placed in the pour cup PC, as shown in FIG. 7 to remove dross and other contaminants from the melt stream before its enters the mold cavities MC1, MC2. In FIG. 7, the filter 60 includes locking tabs 61 that enter and engage in respective slots SL in the pour cup PC to lock the filter in position. The filter alternately, or in addition, can be placed in the gating G of the mold. An advantage of the invention is that the electromagnetic field of coil 40 is not affected by the presence of the filter 60 and feeding of the solidification shrinkage continues as if the filter were not in the pour cup. This is in contrast to prior process using exothermic hot topping applied after casting where any filter must be removed prior to application of the exothermic material.

In practice of an illustrative method embodiment of the invention, the mold M is preheated in the separate mold preheating furnace while the mold is held in a pour cup-down position. After the mold M is preheated in the external preheating furnace to the desired elevated (superambient) casting temperature, the preheated mold is inverted and placed on the locating tubes 71 of mold-locating fixture or stand 72 that resides on the elevator 50 in the chamber 12. The door 32 is closed and sealed gas-tight.

The chamber 12 then typically is evacuated to the same vacuum level as chamber 10, and then the valve 14 is opened and the preheated mold M on fixture or stand 72 is raised using the elevator 50 to the casting position where the pour cup PC is positioned within and locally adjacent to the VIHT coil 40 and beneath the crucible 30 where the pour cup PC can receive the poured melt stream from the crucible 30.

The solid charge in the crucible 30 can be melted under vacuum in chamber 10 before or after the preheated mold M is raised to the casting position. Typically, the mold M is preheated outside the chambers 10, 12 and transported onto the fixture or stand 72 on the elevator 50 in chamber 12 concurrent with the melting of the solid charge in the crucible 30 under vacuum in chamber 10.

The crucible 30 then is rotated to introduce (pour) the superalloy melt into the pour cup PC (melt reservoir) and gating G of preheated mold M residing in a vacuum chamber 10 so as to fill a mold cavities MC1, MC2 with the superalloy melt via the pour cup PC and gating G. The superalloy melt is introduced into the preheated mold M to completely fill the mold cavities MC1, MC2 with the superalloy melt and to leave excess superalloy melt in the pour cup PC as a melt reservoir and in the gating G above the mold cavities.

Immediately after the mold is filled, the VIHT coil 40 is energized by power source S to locally heat the superalloy melt remaining in the pour cup PC and adjacent gating G if needed to maintain it molten as the superalloy melt solidifies under vacuum in the mold cavities MC1, MC2 of the preheated mold M in chamber 10. The electromagnetic field of the coil 40 couples to the excess superalloy melt remaining in the pour cup to locally heat the excess melt in the pour cup and adjacent gating without substantially heating the regions R1, R2 of the mold in which the mold cavities reside. The coil 40 typically is energized until the superalloy melt solidifies completely in the mold cavities MC1, MC2 and then the power is reduced to allow the alloy in the reservoir (pour cup) to solidify prior to removing from the vacuum furnace.

The inner diameter and height (number of coil turns) of the coil 40 and as well as the spacing of the VIHT coil 40 relative to the mold pour cup PC and the level of coil energization is/are selected in dependence on the dimensions of the mold pour cup PC and amount of excess superalloy melt therein so that the coil's electromagnetic field couples with the excess superalloy melt in the pour cup to locally heat it as the superalloy melt solidifies in the mold cavities.

The induction coil 40 is designed to maximize coupling with the excess superalloy in the pour cup PC by minimizing the distance from the molten alloy to the coil. Typically the distance ranges from 2-4 inches but may be more or less depending on specific component geometries. Further a minimum of energy is used to maintain the alloy in the pour cup PC in a molten state. This energy may be varied during operation in order to allow the alloy in the pour cup to freeze over providing for a minimum of oxides and nitrides in the residual alloy in the pour cup. This ensures it will be suitable for re-use. It is also advantageous to time the freezing of the alloy in the pour cup to the end of solidification in the casting so that the mold is removed from the casting chamber 10 and lower chamber 12 in time to allow another mold to be loaded in time to pour without adversely affecting cycle time.

The superalloy melt solidifies under vacuum in the mold cavities MC1, MC2 over time to produce an equiaxed grain, superalloy cast part without shrinkage defects and without the presence of a reactive element oxide scale resulting from oxidation of a reactive element of the superalloy, such as hafnium present in certain nickel base superalloys. If desired, the rate of solidification in chamber 10 can be increased by introducing an inert thermally conductive cooling gas, such as argon, into the chamber 10 for a period of time after the superalloy melt is poured into the preheated mold M.

Once the superalloy melt is completely solidified in the mold and cooled to a few hundred degrees below the alloy solidus temperature, the valve 14 can be opened, and the cast mold lowered into chamber 12 using the mold elevator 50 where it can be cooled to ambient temperature inside the chamber 12, or it can be removed outside of the chamber 12 to finish cooling in ambient air.

Figure 6:
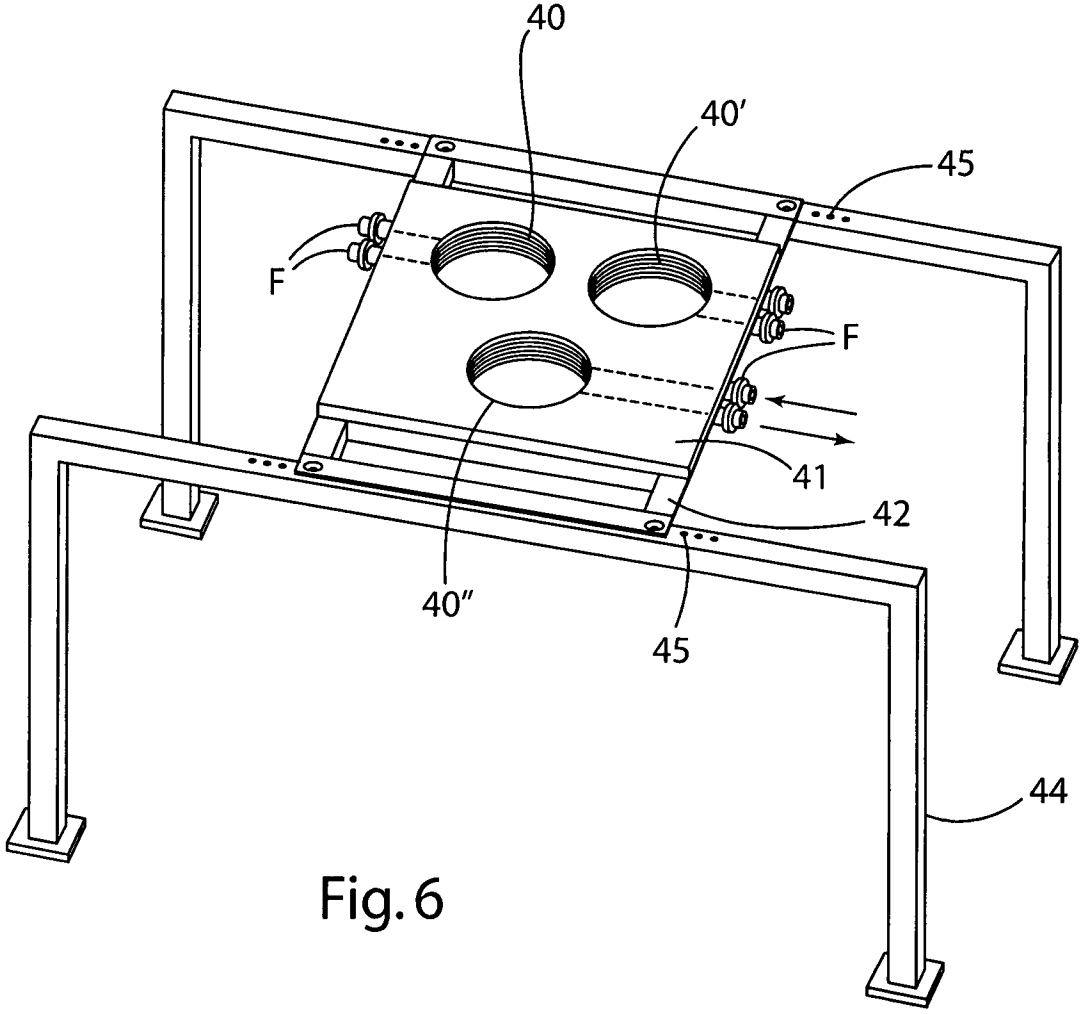
FIG. 6 is a schematic perspective view of the induction coil support frames and multiple VIHT coils mounted on the support frames to supply heat to multiple pour cups of a preheated mold.

As illustrated in FIG. 6, multiple VIHT coils 40, 40', 40" can be provided on support plate 41' of supports 42', 44' in the event the mold M includes multiple pour cups or other reservoirs, such as might be used to cast a larger gas turbine engine vane. Design and operation of the coils 40, 40', 40" involve the same features as described above for the single VIHT coil 40.

Practice of the present invention is advantageous to avoid occurrence of severe reactions (flash and burning) associated with previously-used exothermic material placed on the melt in the mold pour cup, to avoid contamination of solidified metallic material remaining in the mold pour cup after solidification so that it can be reused, to avoid shrinkage defects in the cast part, and to avoid the formation of unwanted reactive element oxides as surface scale at last-to-solidify regions of the cast part when certain superalloys are cast.

The following example is offered to further illustrate and not limit the invention.

Example

An equiaxed grain gas turbine engine blade having a length of 26 inches and weight of 23 pounds was vacuum cast from a Mar-M 247 nickel base superalloy using apparatus similar to that described above and shown in FIGS. 1-5.

The mold preheat temperature was 2200° F. The superalloy pour temperature was 2705° F. using a melting cycle time in the crucible of about 25 minutes. The superalloy melt pour time into the mold was about 10 seconds.

The VIHT coil was 8 inches in inner diameter with 4 coil turns. The inner surface of the VIHT oil was faced with a alumina, silica, zircon grout ceramic layer applied by hand and formed by mandrel. The inner surface of the VIHT coil was spaced 0.5 inch from the largest diameter of the pour cup. The VIHT coil was energized immediately after pouring the molten alloy into the mold and at a power level of 90 kW for 10 minutes. Then power was gradually reduce to 0 kW until alloy in the pour cup froze. The total VIHT cycle time as about 20 minutes. After the alloy in the pour cup was solidified the mold was lowered into the lower mold chamber 12 and removed to finish cooling in air. The vacuum level in the vacuum casting chamber at pour was 15 μm-Hg.

The cast blade had an equiaxed grain microstructure and was free of shrinkage defects and hafnium oxide scale at the last-to-solidify root region of the cast blade. Moreover, the solidified superalloy in the pour cup was closed and free of oxide contamination so that it could be reused as revert to cast another part.

Air Casting:

Another illustrative embodiment of the invention is useful, although not limited to, casting of stainless steel (or other metals or alloys) in air. Such stainless steels include, but are not limited to, ferritic, austenitic and PH (precipitation hardening) stainless steels. The method and apparatus involve introducing molten metallic material (melt) into a preheated mold in ambient air (atmospheric air) wherein the mold has a melt reservoir, such as a pour cup, and gating that feed the melt to one or more mold cavities. Excess melt is provided in the melt reservoir, such as the pour cup, and the gating for feeding to the one or more mold cavities during solidification there. An induction coil like coil 40 is disposed locally adjacent to the melt reservoir and is energized in a manner to locally heat the excess melt in the melt reservoir to maintain it molten as the molten metallic material solidifies in air in the one or more mold cavities of the preheated mold. The excess molten metallic material is fed as needed to eliminate shrinkage defects as solidification proceeds in air in the mold cavity.

For example, the chambers 10, 12 described above simply can be left open to ambient air (atmospheric air pressure) during the sequence of steps described above for casting a stainless steel melt into the preheated mold. Alternately, the chambers 10, 12 can be dispensed with such that a preheated mold can be moved to position its pour cup in a VIHT coil of the type shown as "40" in FIG. 5 and cast in air using a crucible of the type shown as "30" in FIGS. 1 and 2 containing the stainless steel melt located above the mold pour cup in air. The VIHT coil could be supported on a support plate and supports like those shown in FIG. 5.

Although the invention has been described hereinabove in terms of specific embodiments thereof, it is not intended to be limited thereto but rather only to the extent set forth hereafter in the appended claims.

We claim:

1. A method of casting a molten metallic material, comprising:

providing an induction coil in fixed position beneath a crucible for containing the molten metallic material in a casting chamber where, in the casting chamber, the molten metallic material is discharged from the crucible into a mold to be cast, wherein the induction coil has an opening disposed beneath the crucible and has a coil height that extends only along a melt reservoir of the mold, moving the mold that is preheated outside of the casting chamber into the casting chamber to position only the melt reservoir associated with the preheated mold in the coil opening of the induction coil so that the induction coil extends only along the melt reservoir and is locally adjacent to the melt reservoir, leaving a region of the preheated mold including one or more mold cavities disposed beneath and outside of the induction coil in the casting chamber, discharging the molten metallic material from the crucible in the casting chamber through the coil opening into the melt reservoir to introduce molten metallic material into the preheated mold via the melt reservoir and gating that feeds the molten metallic material to the one or more mold cavities so as to completely fill the one or more mold cavities with the molten metallic material and provide excess molten metallic material in the melt reservoir and gating, and energizing the induction coil extending along only the melt reservoir and disposed locally adjacent to the melt reservoir in the casting chamber in a manner to locally heat the molten metallic material in the melt reservoir to maintain it molten as the molten metallic material solidifies in the one or more mold cavities of the preheated mold while the mold resides in the casting chamber.

2. The method of claim 1 wherein the induction coil is energized to locally heat the molten metallic material in the melt reservoir and the gating adjacent to the melt reservoir without substantially heating the region of the mold in which the one or more mold cavities reside and where the melt solidifies.

3. The method of claim 1 wherein the melt reservoir is a mold pour cup disposed above the one or more mold cavities.

4. The method of claim 1 wherein the induction coil is energized until the molten metallic material in the one or more mold cavities solidifies.

5. The method of claim 1 wherein the mold is disposed in an upper vacuum casting chamber that is evacuated to a pressure less than 20 μm Hg before the molten metallic material is introduced into the preheated mold.

6. The method of claim 1 wherein the mold is disposed in air.

7. The method of claim 5 including moving the preheated mold from a lower chamber to beneath the induction coil in the upper vacuum casting chamber so that the induction coil resides locally around the melt reservoir prior to introduction of the molten metallic material into the preheated mold.

8. The method of claim 1 including the additional step of reusing the solidified material remaining in the melt reservoir in making another casting.

9. The method of claim 1 including providing multiple reservoirs and a respective induction coil adjacent each reservoir.

10. A method of vacuum casting a molten superalloy containing an oxygen-reactive alloying element, comprising:

providing an induction coil in fixed position in an upper vacuum casting chamber beneath a crucible for containing the molten superalloy in the upper vacuum casting chamber, wherein the induction coil has an opening disposed beneath the crucible and has a coil height that extends only along a pour cup of a mold to be cast, moving the mold that is preheated outside of the vacuum casting chamber from a lower chamber into the upper vacuum casting chamber to position only the pour cup of the preheated mold in the coil opening of the induction coil so that the induction coil extends only along the pour cup and is locally adjacent to the pour cup, leaving a region of the preheated mold including one or more mold cavities beneath and outside of the induction coil in the upper vacuum casting chamber, discharging the molten superalloy from the crucible in the upper vacuum casting chamber through the coil opening into the pour cup to introduce molten superalloy melt into the preheated mold in the upper vacuum casting chamber via the pour cup and gating that feed the molten superalloy to the one or more mold cavities so as to completely fill the one or more mold cavities with the molten superalloy and provide excess molten superalloy in the melt pour cup and gating, and energizing the induction coil extending only along the melt reservoir and disposed adjacent to the pour cup in the upper vacuum casting chamber in a manner to locally heat the molten superalloy in the pour cup to maintain it molten as the molten superalloy solidifies under vacuum in the one or more mold cavities of the preheated mold while the mold resides in the upper vacuum casting chamber.

11. The method of claim 10 wherein superalloy contains oxygen-reactive hafnium, zirconium, titanium, and/or aluminum.

12. The method of claim 10 including solidifying the superalloy melt in the mold to form an equiaxed grain cast part without shrinkage defects.

13. The method of claim 12 including solidifying the superalloy melt without the presence of an oxide scale.

14. The method of claim 10 wherein the induction coil is energized to locally heat the pour cup and gating adjacent to the pour cup without substantially heating the region of the mold in which the one or more mold cavities reside.

15. The method of claim 10 wherein the induction coil is energized until the molten superalloy in the one or more mold cavities solidifies in the upper vacuum casting chamber.

16. The method of claim 10 wherein the upper vacuum casting chamber is evacuated to a pressure less than 20 μm Hg before the molten superalloy is introduced into the preheated mold.

17. The method of claim 10 including moving the preheated mold from the lower chamber to beneath the induction coil in the upper vacuum casting chamber so that the induction coil resides locally around the pour cup prior to introduction of the molten superalloy into the preheated mold.

18. The method of claim 10 wherein the one or more mold cavities have the shape of a gas turbine blade or vane to produce a cast blade or cast vane.

19. The method of claim 10 including providing multiple reservoirs and a respective induction coil adjacent each reservoir.

* * * * *